US010239588B2

(12) United States Patent
Determann

(10) Patent No.: US 10,239,588 B2
(45) Date of Patent: Mar. 26, 2019

(54) WATER VEHICLE HAVING A CRANE FOR LIFTING LOADS

(71) Applicants: ThyssenKrupp Marine Systems GmbH, Kiel (DE); ThyssenKrupp AG, Essen (DE)

(72) Inventor: Wolfram Determann, Norderstedt (DE)

(73) Assignees: THYSSENKRUPP MARINE SYSTEMS GMBH, Kiel (DE); THYSSENKRUPP AG, Essen (DE)

( * ) Notice: Subject to any disclaimer, the term of this patent is extended or adjusted under 35 U.S.C. 154(b) by 0 days.

(21) Appl. No.: 15/516,128

(22) PCT Filed: Jul. 28, 2015

(86) PCT No.: PCT/EP2015/067246

§ 371 (c)(1),
(2) Date: Mar. 31, 2017

(87) PCT Pub. No.: WO2016/050381

PCT Pub. Date: Apr. 7, 2016

(65) Prior Publication Data

US 2017/0305506 A1 Oct. 26, 2017

(30) Foreign Application Priority Data

Oct. 2, 2014 (DE) ..... 10 2014 114 331

(51) Int. Cl.
*B63B 27/16* (2006.01)
*B63B 27/30* (2006.01)
(Continued)

(52) U.S. Cl.
CPC ..... *B63B 27/16* (2013.01); *B63B 27/30* (2013.01); *B66C 23/022* (2013.01); *B66C 23/52* (2013.01); *B63B 2015/005* (2013.01)

(58) Field of Classification Search
CPC ..... B63B 27/00; B63B 27/10; B63B 27/12; B63B 27/16; B63B 27/28; B63B 27/30; B63B 23/40; B63B 25/00
(Continued)

(56) References Cited

U.S. PATENT DOCUMENTS 948,304 A * 2/1910 Bode ..... B63B 27/36 114/268
3,938,670 A * 2/1976 Wellman ..... B66C 23/34 212/296
(Continued)

FOREIGN PATENT DOCUMENTS

EP 0124947 A1 11/1984
FR 2808252 A 11/2001
(Continued)

OTHER PUBLICATIONS

English Translation of the International Search Report issued in PCT/EP2015/067246, dated Sep. 18, 2015 (mailed Sep. 28, 2015).
English language abstract of JPH07108981.

*Primary Examiner* — Lars A Olson
(74) *Attorney, Agent, or Firm* — thyssenkrupp North America, Inc.

(57) ABSTRACT

A watercraft may include a crane for lifting loads. The crane may include a tower and a boom that is rotatble with respect to the tower. The tower may be positioned inside the outer contour of the watercraft so as to minimize the profile of the watercraft on radar. The watercraft may include a superstructure within which the tower may be disposed. The superstructure may include planar outer walls that are obtuse relative to a horizontal plane. A rotary bearing may be utilized to connect the boom to the tower and permit the boom to rotate relative to the tower. Further, when the boom
(Continued)

is in a rest position, a lower edge of the boom may be positioned 10 cm or less above the crane deck.

18 Claims, 2 Drawing Sheets

(51) Int. Cl.
*B66C 23/02* (2006.01)
*B66C 23/52* (2006.01)
*B63B 15/00* (2006.01)

(58) Field of Classification Search
USPC ..... 114/268
See application file for complete search history.

(56) References Cited

U.S. PATENT DOCUMENTS

| | | | | |
|---|---|---|---|---|
| 4,112,863 | A | 9/1978 | Nelson | |
| 6,988,459 | B2 | 1/2006 | Roodenburg | |
| 2002/0069806 | A1 | 6/2002 | Le Coz | |
| 2010/0028105 | A1* | 2/2010 | Malchow | B63B 27/10 114/268 |

FOREIGN PATENT DOCUMENTS

| | | | |
|---|---|---|---|
| JP | H07108981 | A | 4/1995 |
| JP | H10305994 | A1 | 11/1998 |
| KR | 1020020025090 | A | 4/2002 |
| NL | 1035627 | C2 | 12/2009 |
| WO | 2012138227 | A1 | 10/2012 |
| WO | 2013070080 | A1 | 5/2013 |
| WO | 2014123414 | A | 8/2014 |

* cited by examiner

WATER VEHICLE HAVING A CRANE FOR LIFTING LOADS

CROSS REFERENCE TO RELATED APPLICATIONS

This application is a U.S. National Stage Entry of International Patent Application Serial Number PCT/EP2015/067246, filed Jul. 28, 2015, which claims priority to German Patent Application No. DE 10 2014 114 331.0 filed Oct. 2, 2014, the entire contents of both of which are incorporated herein by reference.

FIELD

The present disclosure generally relates to watercrafts with cranes for lifting loads, including watercrafts with cranes that have towers and booms that can rotate with respect to the towers.

BACKGROUND

Cranes by means of which loads can be raised and loaded are often provided on watercraft for civil or military uses. For example, U.S. Pat. No. 6,988,459 B2 discloses a watercraft having a crane for loading pieces of equipment. The crane has a tower which is arranged on the main deck of the watercraft and a boom which can rotate with respect to the tower.

Such watercraft have the disadvantage that owing to the crane which projects high above the main deck they have a relatively large radar cross section and therefore their location can be determined relatively easily by radar systems. However, in particular in the case of military watercraft it is desired that the watercraft has a small radar cross section (RCS) so that the probability of discovery by enemy radar devices is reduced.

DETAILED DESCRIPTION

Figure 1:
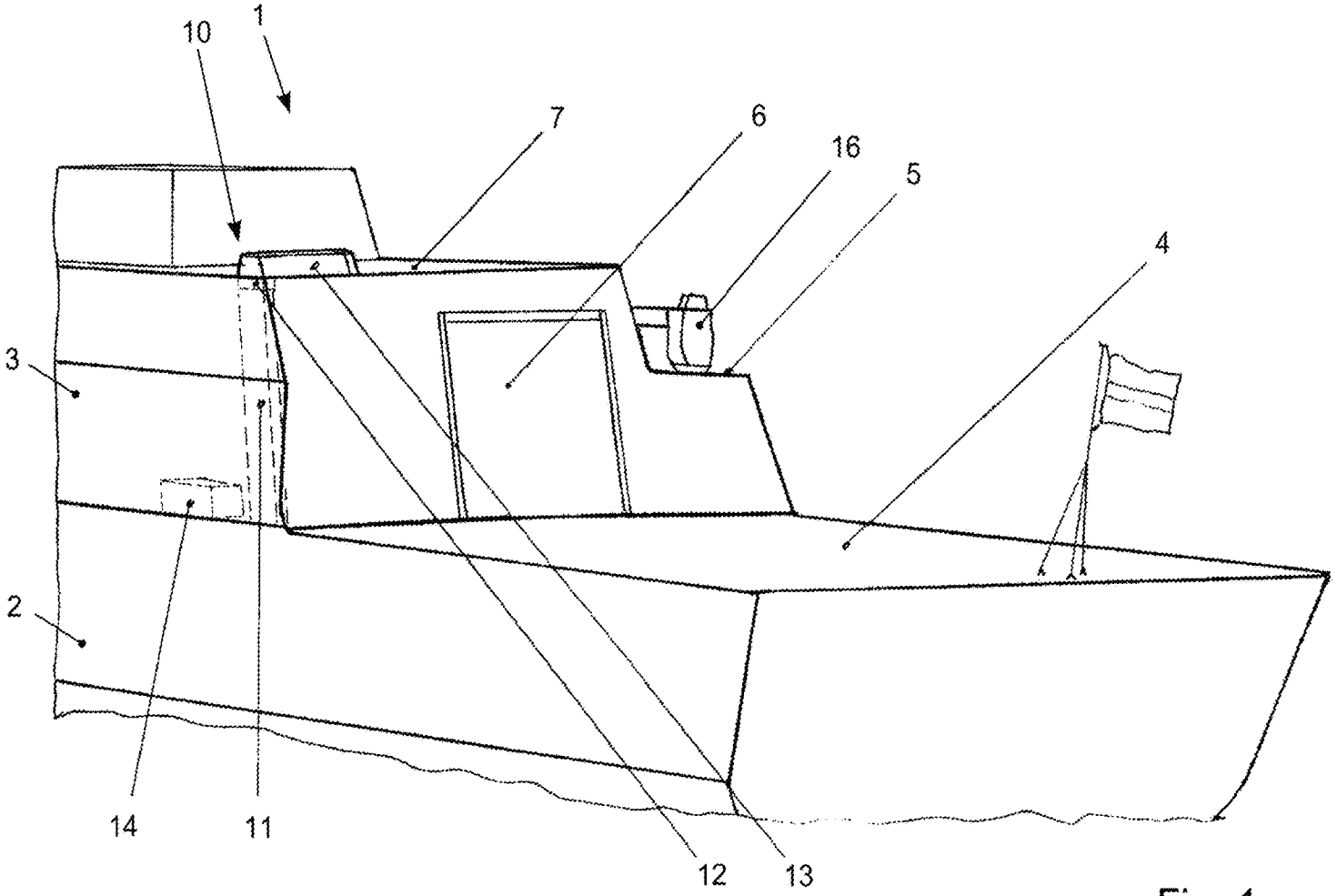
FIG. 1 is a perspective view of an example watercraft with a crane for lifting loads, wherein the crane is in a position of rest.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The One example object of the present disclosure is to reduce the probability of the location of the watercraft being able to be determined by a radar device.

The object is achieved by means of a watercraft having a crane for lifting loads which crane has a tower and a boom which can rotate with respect to the tower, wherein the tower is arranged inside the outer contour of the watercraft.

The arrangement of the tower inside the outer contour of the watercraft prevents the radar radiation which is emitted by a radar device from being reflected back from the surface of the tower to the radar device. Therefore, the contribution of the tower to the radar cross section of the watercraft is eliminated and the radar cross section is reduced overall. As a result of the relatively small radar cross section, the probability of the location of the watercraft being determined by an enemy radar device is reduced.

The tower is preferably arranged within a superstructure of the watercraft. When the tower is arranged within a superstructure, the radar cross section in the region of the crane is determined essentially by the superstructure. This has the advantage that the radar cross section of such superstructures which are already optimized in terms of the radar cross section, for example in the manner of cloaking technology, is increased by the crane only to a small degree. It has proven advantageous if the tower is attached to a deck of the watercraft which supports the superstructure. The deck which supports the superstructure is generally configured in such a way that it can receive the major part of the mechanical load of the superstructure and of the tower. The deck can preferably be embodied in a re-inforced manner in the region in which the tower is attached, for example by virtue of the fact that in this region the deck has an increased material strength and/or has increased density of frames.

One advantageous refinement provides that the boom is connected to the tower via a rotary bearing which is arranged inside the outer contour of the watercraft. A rotation of the boom with respect to the tower is made possible by means of the rotary bearing. By virtue of the arrangement of the rotary bearing inside the outer contour of the watercraft, the region of the crane which protrudes out of the outer contour can be reduced essentially to the boom. Neither the tower nor the rotary bearing therefore contribute to the radar cross section of the watercraft. It is structurally advantageous if the rotary bearing terminates flush with the outer contour. The boom can be connected rigidly to the rotary bearing, with the result that the boom can be rotated with respect to the tower. The boom preferably rotates about a vertical rotational axis. The rotational axis particularly preferably extends parallel to a longitudinal axis of the tower. A rotation of the boom about an axis which is arranged transversely, in particular perpendicularly, with respect to the longitudinal axis of the tower is particularly preferably blocked. In addition it is advantageous if the rotary bearing is embodied as a live ring, so that a free space, e.g. for leading through supply lines, can be made available in the interior of the live ring.

A refinement in which the boom can be moved into a position of rest in which the boom is arranged above a crane deck of the watercraft, wherein the distance between a lower edge of the boom and the crane desk is less than 10 cm, preferably less than 5 cm, particularly preferably less than 1 cm is advantageous. The crane deck can form the outer contour of the watercraft above the tower of the crane. The crane deck is preferably a deck which is arranged above the main deck and which terminates a superstructure in the upward direction. A distance between the lower edge of the boom and the crane deck which is as short as possible provides the advantage that, in the position of rest, the boom almost bears on the crane deck and therefore gives rise only to a small increase in the radar cross section. The distance between the lower edge of the boom and the crane deck is advantageously dimensioned in such a way that the boom can rotate freely above the crane deck. At least one sliding rail is particularly preferably arranged in the space between the lower edge of the boom and the crane deck.

In this context, a refinement in which a side wall of the boom in the position of rest encloses an obtuse angle with the crane deck has proven particularly advantageous. As a result of the obtuse angle between the side wall of the boom and the crane deck, radar waves which impinge laterally on the boom can be reflected upward, with the result that the probability of backward reflection to the source of the radar radiation is reduced. Alternatively, a side wall of the boom in the position of rest can form a continuation of an inclined face of the outer contour of the watercraft, with the result that the side wall of the boom adjoins flush with the face. The face of the outer contour can be formed by a face of a superstructure of the watercraft. The side wall of the boom can be part of a cover of the boom.

It is preferred if the boom can be moved into a position of use in which a free end of the boom projects laterally above an edge of the crane deck, with the result that loads can be loaded in the region to the side of the crane deck. The boom can be moved from the position of rest into the position of use by rotation with respect to the tower, and vice versa.

The distance of the boom from a main deck of the watercraft in the position of use particularly preferably has a value in the region of 1 to 3 deck heights, preferably of two deck heights. A deck height corresponds to the structural heights of a deck of the superstructure of the watercraft. The deck height is preferably in the range of 3 m to 9 m, particularly in the range from 4 m to 6 m.

A refinement in which the boom is embodied in a rod shape is constructively advantageous. The cross section of the boom can be round or polygonal. It is also advantageous if the boom is arranged essentially at a right angle to a longitudinal axis of the tower. Furthermore, it is advantageous if the boom is composed of at least partially of a metal and/or of a composite fiber material. It is particularly advantageous if the boom is embodied at least partially from a carbon-fiber composite material.

One preferred refinement provides that the boom is of telescopic design, with the result that the cable-suspension point of the crane can be moved in a radial direction with respect to the tower. It is therefore not necessary for a crane trolley to be provided on the boom in order to move the cable-suspension point radially. The boom can have a plurality of boom segments which can move with respect to one another. The boom preferably has two, three, four or five segments. The segments can be embodied in such a way that one segment of the boom can be respectively retracted into an adjacent segment. With such a refinement, the cable-suspension point can be moved by shifting the individual segments with respect to one another. In its completely extended state, the boom advantageously has at least a length which corresponds to half the width of the watercraft.

It is also preferred if the crane has a crane hook which can be moved into a position in which the crane hook is arranged, in particular, completely within the boom, with the result that the crane hook cannot be seen from the outside. The crane hook can be drawn and/or folded into the boom.

The tower is preferably of telescopic design, with the result that the height of the boom can be moved in a direction which is arranged parallel, in particular vertically, with respect to the longitudinal axis of the tower. The height of the boom can be adjusted in order to permit loading of loads which have a larger height and/or which are to be loaded at a level which is above the outer contour of the watercraft. The tower can have a plurality of tower segments which can be moved with respect to one another, for example two, three, four or five. The tower segments can be embodied in such a way that one tower segment can be retracted into an adjacent tower segment.

It is also advantageous if the tower has a sea-swell-following device for compensating for a sea-swell-induced movement of a cable-suspension point of the crane. By means of the sea-swell-following device, the crane can also be used on the open sea even when there is strong swell. It is particularly advantageous if the sea-swell-following device is arranged in the tower, with the result that no additional requirement for space arises. The sea-swell-following device can have, for example, a hydraulic cylinder which is arranged in the tower.

One advantageous refinement provides that the crane has a cable winch and/or a hydraulic assembly which is arranged inside the outer contour of the watercraft. As a result of the arrangement of the cable winch or of the hydraulic assembly inside the outer contour of the watercraft, in particular underneath a deck and/or within a superstructure of the ship, the radar cross section of the watercraft is not adversely affected. In addition, the risk of corrosion to the cable winch or to the hydraulic assembly is reduced.

The crane is preferably of remote-controllable design, with the result that it is not necessary for an operator of the crane to have to stay on a deck of the watercraft. As a result the risk to the crew from enemy threats and/or strong swell of the sea can be reduced.

According to one further advantageous refinement, the watercraft has two cranes. The cranes can be arranged on two opposite sides of the watercraft, for example on the port side and the starboard side. The two cranes are preferably operated at the same time. The length of the boom of the two cranes can be selected such that the two booms cannot impede one another, in particular in a position of maximum extension. The length of the booms is, for example, selected such that it is shorter than half the distance between the towers of the two cranes.

Further details, features and advantages of the invention can be found in the drawings as well as in the following description of preferred embodiments with reference to the drawings. The drawings illustrate here merely exemplary embodiments of the invention which do not restrict the inventive concept.

FIG. 1 illustrates the stern of a watercraft 1 according to a first exemplary embodiment of the invention. The watercraft 1 is configured as a military sea vessel, for example as a corvette or patrol ship. In the region of the stern, the watercraft 1 has a main deck 4 which limits the hull 2 in the upward direction and which is used as a helicopter landing deck. A superstructure 3, which extends over a height of two decks and accommodates a hangar storing helicopters and other pieces of equipment, is arranged on the main deck 4. The superstructure is limited in the upward direction by a crane deck 7. The crane deck 7 therefore forms part of the outer contour of the watercraft 1.

A crane 16 embodied according to the prior art is provided on the starboard side, on an intermediate deck arranged between the main deck 4 and the crane deck 7. The crane is embodied as a loading crane which is permanently installed on the intermediate deck 7. In an out-of-use position shown in FIG. 1, the crane 16 rests in a retracted fashion on a bearing of a crane arm. As a result of the crane 16 resting on the intermediate deck, the radar cross section of the watercraft 1 is degraded significantly on the starboard side and from astern.

In order to make the radar cross section of the watercraft 1 smaller and therefore to reduce the possibility of the watercraft 1 being discovered by enemy radar, instead of the crane 16 known from the prior art it is possible to use a crane 10 according to the invention, which crane 10 is illustrated by way of example on the port side of the watercraft 1. The crane 10 can be provided in a form which differs from the exemplary embodiment on the starboard side. According to a further refinement, the watercraft 1 can have two cranes, for example a crane on the port side and a crane on the starboard side, respectively.

The crane 10 has a tower 11 and a boom 13 which can rotate with respect to the tower 11. The tower 11 of the crane 10 is arranged inside the outer contour of the watercraft 1, with the result that the radar radiation which is emitted by a radar device is reflected by the outer contour of the watercraft 1, here the surface of the superstructure 3, and cannot impinge on the tower 11. The contribution of the tower 11 to the radar cross section of the watercraft 1 is therefore eliminated, and the radar cross section is reduced overall. In the exemplary embodiment, the tower 11 is arranged within the superstructure 3. The superstructure 3 can be configured in the manner of a cloaking device and have a radar cross section which is reduced compared to conventional superstructures. This can be achieved, for example, by virtue of the fact that the outer walls of the superstructure 3 are of planar design and have an obtuse angle with respect to the horizontal.

The crane 10 is embodied as a revolving tower crane which is integrated into the superstructure 3 and whose tower 11 is arranged completely below the crane deck 7. The boom 13 of the crane 10 is rigidly connected to a rotary bearing 12 which is embodied as a live ring, with the result that the boom 13 can be rotated about the longitudinal axis of the tower 11, but there is no degree of freedom about a rotational axis transversely, in particular perpendicularly, with respect to the longitudinal axis of the tower 11. In the exemplary embodiment, the rotary bearing 12 is arranged together with the tower 11 inside the outer contour of the watercraft 1 and therefore does not contribute to the radar cross section of the watercraft 1. The rotary bearing 12 terminates flush with the upper edge of the superstructure 3, that is to say the crane deck 7.

In the illustration according to FIG. 1 the boom 13 of the crane 10 is in a position of rest in which the boom 13 is arranged above the crane deck 7, and the distance between the lower edge of the boom 13 and the crane deck 7 is as short as possible. The boom 13 can rest directly on the crane deck 7 or alternatively rest on thin sliding bearings which are mounted on the crane deck 7. According to the exemplary embodiment, the distance is less than 10 cm, preferably less than 5 cm, particularly preferably less than 1 cm. The boom 13 is embodied overall in the manner of a rod which extends from the rotary bearing 12 along a straight line which encloses a right angle with the longitudinal axis of the tower 11. The side walls of the boom 13 enclose, in the position of use, an obtuse angle with the surface of the crane deck 7. In the exemplary embodiment, the boom 13 in the position of rest is arranged in a position transversely, in particular at a right angle, with respect to the longitudinal axis of the watercraft 1. Alternatively, the boom 13 in the position of rest can be arranged parallel to the longitudinal axis of the watercraft 1.

A cable winch 14 and a hydraulic assembly (not illustrated) are also arranged within the superstructure 3. The crane 10 is remote-controllable, with the result that members of the crew for operating the crane 10 can assume an optimum position.

Figure 2:
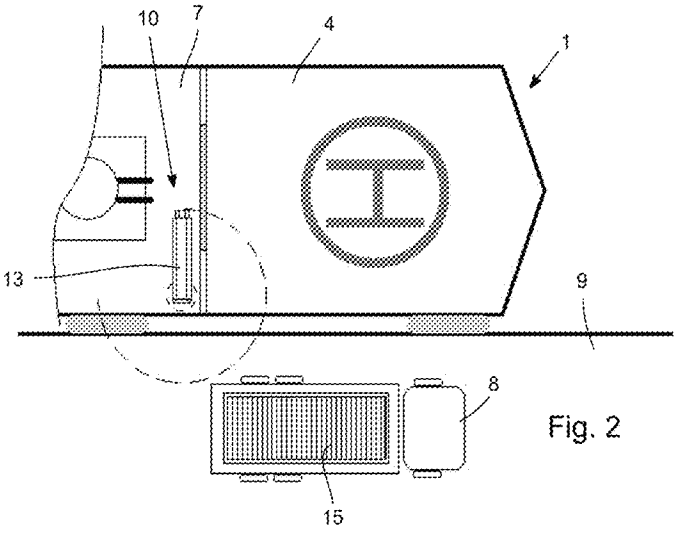
FIG. 2 is a plan view of another example watercraft with a crane for lifting loads, wherein the crane is in a position of rest.
Figure 3:
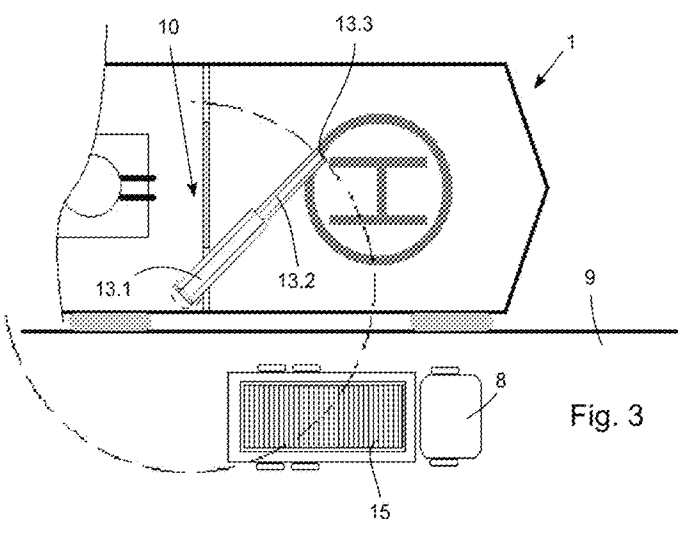
FIG. 3 is a plan view of the example watercraft of FIG. 2, wherein the crane is in a first position of use.
Figure 4:
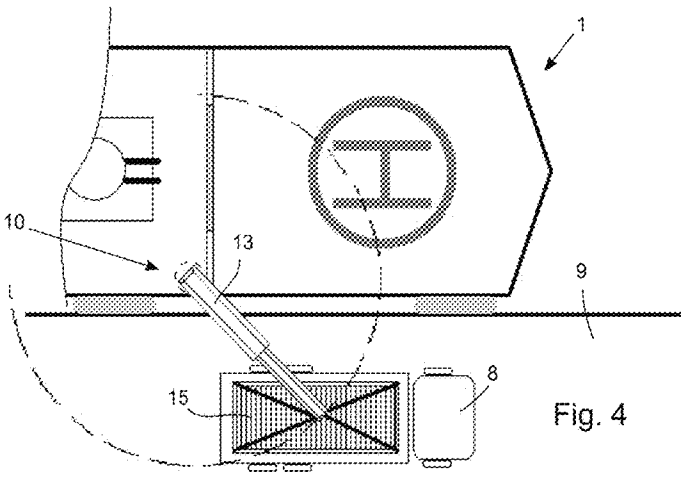
FIG. 4 is a plan view of the example watercraft of FIG. 2, wherein the crane is in a second position of use.

The illustrations in FIGS. 2, 3 and 4 show a second exemplary embodiment of the invention. In FIG. 2, the crane 10 is in the position of rest. In FIGS. 3 and 4, the crane assumes two different positions of use, wherein the free end 13.3 of the boom 13 respectively of two boom segments 13.1, 13.2 projects laterally beyond the edge of the crane deck. In the position of use according to FIG. 2, the boom is arranged at a distance of approximately 5 m above the main deck 4. This height is sufficient for loading helicopters, drones, transport containers, boats and other loads between the watercraft 1 and the land, with the result that it is not necessary to top the crane. FIG. 3 shows the crane 10 when picking up a load 15 from a land vehicle 8 which is located on a quay wall 9.

In one refinement of the exemplary embodiment described above, the crane 10 can have a sea-swell-following device by means of which sea-swell-induced movements of the cable-suspension point of the crane 10 can be compensated for. The sea-swell-following device can be integrated in the tower 11.

The watercraft 1 described above have a crane 10 for lifting loads, which crane 10 has a tower 11 and a boom 13 which can rotate with respect to the tower 11, wherein the tower 11 is arranged inside the outer contour of the watercraft 1.

LIST OF REFERENCE NUMBERS

1 Watercraft
2 Hull
3 Superstructure
4 Main deck
5 Intermediate deck
6 Hangar
7 Crane deck
8 Land vehicle
9 Quay wall
10 Crane
11 Tower
12 Live ring
13 Boom
13.1, 13.2 Boom segment
13.3 Free end
14 Cable winch
15 Load
16 Crane

What is claimed is:

1. A watercraft, comprising:

a superstructure; and a crane for lifting loads, wherein the crane comprises, a tower disposed inside the superstructure, and a boom that is rotatable with respect to the tower, wherein the tower is disposed inside an outer contour of the watercraft such that the contribution of the tower to a radar cross section of the watercraft is eliminated.

2. The watercraft of claim 1 wherein outer walls of the superstructure are planar and have an obtuse angle with respect to a horizontal plane.

3. The watercraft of claim 1 further comprising a rotary bearing that connects the boom to the tower, wherein the rotary bearing is disposed inside the outer contour of the watercraft.

4. The watercraft of claim 1 wherein the boom is movable into a rest position in which the boom is disposed above a crane deck of the watercraft such that a distance between a lower edge of the boom and the crane deck is less than 10 cm.

5. The watercraft of claim 4 wherein in the rest position at least one of:

a side wall of the boom encloses an obtuse angle with the crane deck, or a side wall of the boom forms a continuation of a suitable surface of the outer contour of the watercraft.

6. The watercraft of claim 1 wherein the boom is movable into a use position in which a free end of the boom projects laterally beyond an edge of a crane deck of the watercraft.

7. The watercraft of claim 6 wherein in the use position a distance of the boom from a main deck of the watercraft is in a range of 1 to 3 deck heights.

8. The watercraft of claim 1 wherein the boom is configured in a rod shape.

9. The watercraft of claim 1 wherein the boom is disposed substantially at a right angle to a longitudinal axis of the tower.

10. The watercraft of claim 1 wherein the boom is telescopic.

11. The watercraft of claim 1 wherein the crane comprises a crane hook that is movable into a position in which the crane hook is disposed within the boom.

12. The watercraft of claim 1 wherein the tower is telescopic.

13. The watercraft of claim 1 wherein the tower comprises a sea-swell-following device for compensating for a sea-swell-induced movement of a cable-suspension point of the crane.

14. The watercraft of claim 1 wherein the crane comprises at least one of a cable winch or a hydraulic assembly disposed inside the outer contour of the watercraft.

15. The watercraft of claim 1 wherein the crane is remote controllable.

16. The watercraft of claim 1 wherein the crane is a first crane, the watercraft further comprising a second crane.

17. The watercraft of claim 1 wherein the tower is disposed below a crane deck.

18. The watercraft of claim 1 wherein the boom is movable into a rest position in which the boom is disposed above a crane deck of the watercraft such that a distance between a lower edge of the boom and the crane deck is less than 1 cm.

* * * * *